US005622322A

United States Patent [19]

Tamura et al.

[11] Patent Number: 5,622,322

[45] Date of Patent: Apr. 22, 1997

[54] SELF-PROPELLED CRUSHING MACHINE

[75] Inventors: Yukio Tamura; Yasutaka Nishida, both of Kawasaki, Japan

[73] Assignee: Kabushiki Kaisha Komatsu Seisakusho, Tokyo, Japan

[21] Appl. No.: 387,895

[22] PCT Filed: Sep. 14, 1993

[86] PCT No.: PCT/JP93/01312

§ 371 Date: Feb. 21, 1995

§ 102(e) Date: Feb. 21, 1995

[87] PCT Pub. No.: WO94/06561

PCT Pub. Date: Mar. 31, 1994

[30] Foreign Application Priority Data

Sep. 14, 1992 [JP] Japan ..... 4-070014 U

[51] Int. Cl.[6] ..... B02C 13/286

[52] U.S. Cl. ..... 241/101.74; 211/186.2

[58] Field of Search ..... 241/101.74, 101.741, 241/101.742, 186.2, 224, 248, 249, 202, 265, 186.3

[56] References Cited

U.S. PATENT DOCUMENTS

| | | | |
|---|---|---|---|
| 1,534,855 | 4/1925 | Lowenthal | 241/224 X |
| 3,186,651 | 6/1965 | Briolini | 241/224 X |
| 4,073,445 | 2/1978 | Clonch . | |
| 4,961,542 | 10/1990 | Besten et al. . | |
| 4,997,135 | 3/1991 | Zehr . | |
| 5,161,744 | 11/1992 | Schoop et al. . | |

FOREIGN PATENT DOCUMENTS

| | | |
|---|---|---|
| 9115117 | 4/1992 | Germany . |
| 62-40687 | 10/1987 | Japan . |
| 63-77553 | 4/1988 | Japan . |
| 64-32744 | 3/1989 | Japan . |
| 3-130859 | 12/1991 | Japan . |

*Primary Examiner*—Mark Rosenbaum

*Attorney, Agent, or Firm*—Frishauf, Holtz, Goodman, Langer & Chick

[57] ABSTRACT

A self-propelling crushing machine is constructed by mounting a hopper (11) and a crusher (8) connected to said hopper on a vehicle body (1) having a traveling device (19), wherein a bottom plate (51) of said hopper (11) is designed for reciprocal motion in a horizontal direction relative to a charge inlet (**8*b*) of said crusher. The bottom plate (51) receives an object of crush and then feeds into the charge inlet (8*b*) of the crusher (8**) by reciprocal motion of the bottom plate to drop into the latter. Therefore, even when the weight of the object of crush or the charge amount of the object of crush into the hopper fluctuates, a substantially constant amount of object of crush can be fed into the crusher.

6 Claims, 5 Drawing Sheets

SELF-PROPELLED CRUSHING MACHINE

FIELD OF THE INVENTION

The present invention relates to a self-propelled crushing machine for crushing materials ("the object of crush") such as a concrete waste and so forth at a site of taking down a building or so forth.

BACKGROUND ART

As conventional self-propelled crushing machine, there has been known the machine, in which an operator's cabin, a hopper, a crusher and a driving power source and so forth are mounted on a vehicular chassis provided with a pair of left and right traveling bodies, and a discharge conveyer is provided beneath the vehicular chassis in risible fashion, as disclosed in Japanese Unexamined Utility Model Publication No. 64-32744.

These self-propelled crushing machines can travel by themselves and can finely crush the object of crush, such as the concrete wastes and so forth charged in the hopper, and discharge the crushed pieces out of the vehicular chassis through the discharge conveyer.

Such a conventional self-propelling crushing machine is charged with the object of crush and directly feeds the object of crush into the crusher from the hopper by dropping. Therefore, the object of crush falls along the hopper by its own weight. This results in fluctuation of feed amount of the object of crush into the crusher per a unit period depending upon the weight of the object of crush or charge amount of the object of crush into the hopper to make it impossible for the crusher to operate stably. Furthermore, blocking of the object of crush in the hopper may cause difficulty in feeding the object of crush into the crusher.

Therefore, it is an object of the present invention to provide a self-propelling crushing machine which can feed a substantially constant amount of object of crush into a crusher even when the weight of the object of crush or the charge amount of the object of crush into the hopper fluctuate, to thereby permit stable crushing operation of the crusher, and avoid the possibility of blockage of the object of crush within a hopper.

DISCLOSURE OF THE INVENTION

In order to accomplish the above-mentioned and other objects, according to one aspect of the invention, a self-propelling crushing machine constructed by mounting a hopper and a crusher connected to said hopper on a vehicle body having a traveling device, is characterized in that a bottom plate of said hopper is designed for reciprocal motion in a horizontal direction relative to a charge inlet of said crusher.

With the construction set forth above, the bottom plate of the hopper receives the object of crush and then feeds it into the charge inlet of the crusher by reciprocal motion. As a result, a substantially constant amount of the object of crush may be fed into the crusher per a unit period, even when the weight of the object of crush or the charge amount thereof fed into the hopper fluctuates. Accordingly, stable crushing operation can be performed by the crusher. Also, the hopper may not be blocked by the object of crush.

In the construction set forth above, it is preferred that said bottom plate of said hopper and a circular plate rotatingly driven by a motor are connected to each other by a link for reciprocally driving said bottom plate by rotation of said circular plate.

With the construction set forth above, a discharge conveyer is disposed between said left and right pair of traveling mechanisms.

Also, said discharge conveyer is tiltable.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

BEST MODE FOR IMPLEMENTING THE INVENTION

The preferred embodiment of a self-propelling crushing machine according to the present invention will now be explained with reference to FIGS. 1 to 5.

Figure 1:
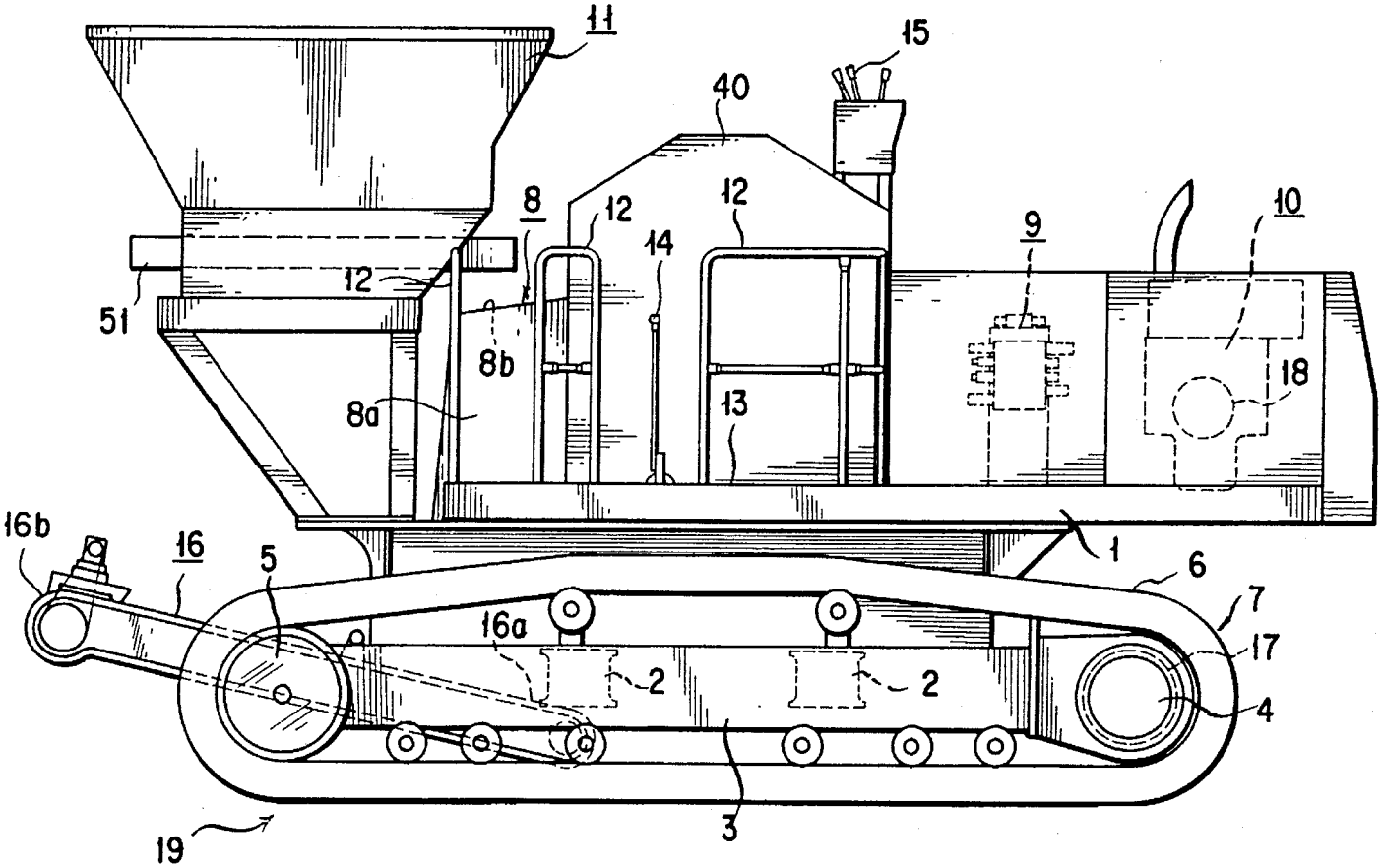
FIG. 1 is a side elevation of one embodiment of a self-propelling crushing machine according to the present invention.
Figure 2:
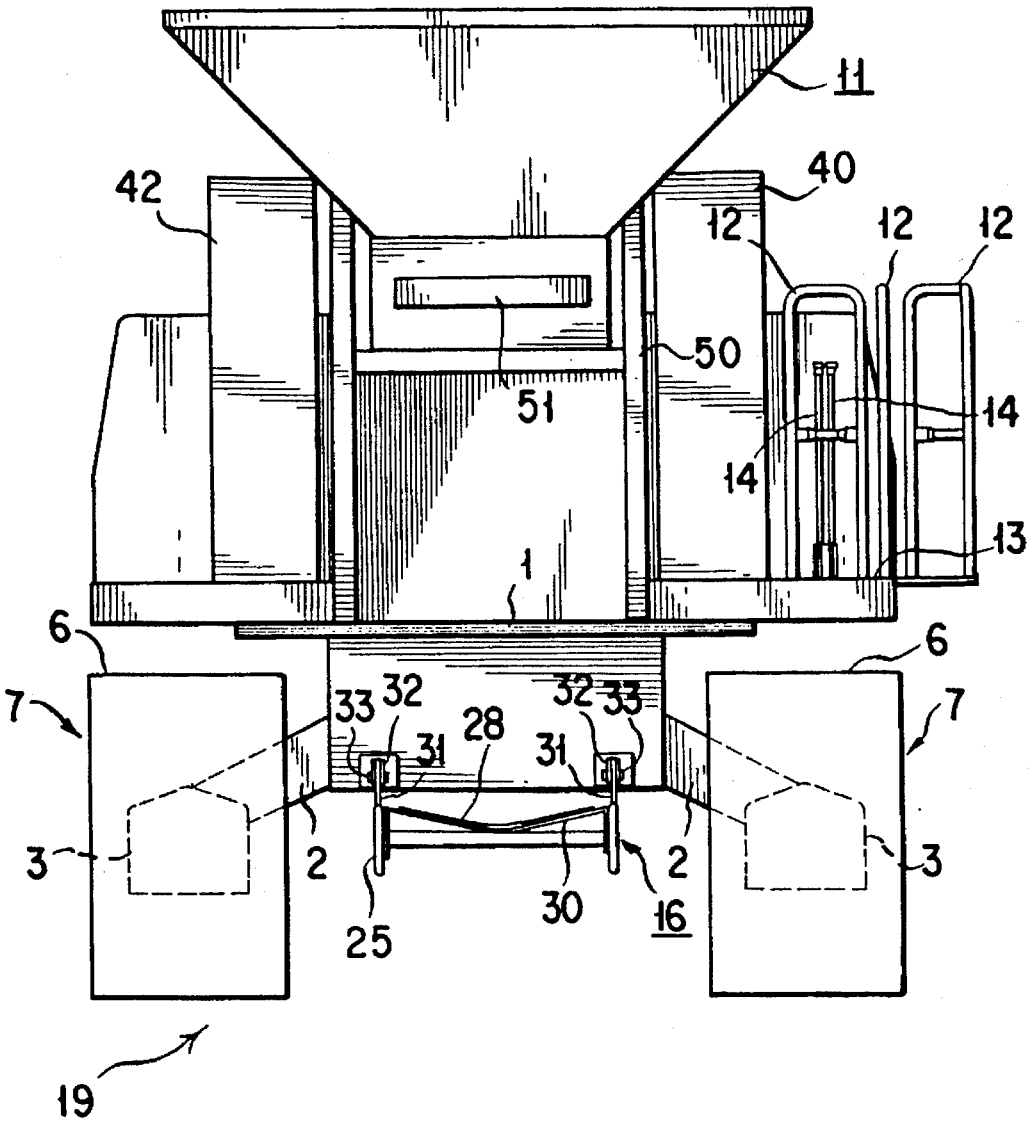
FIG. 2 is a front elevation of the above-mentioned embodiment.

As shown in FIG. 1 and 2, a pair of left and right truck frames 3, 3 are mounted on the lower left and right sides of a vehicular chassis 1 via cross members 2. On the truck frame 3, a hydraulic motor 17, a sprocket 4 and an idler 5 driven by the hydraulic motor 17 are mounted. A crawler 6 is wound over the sprocket 4 and the idler 5 to form a crawler type drive mechanism 7. A pair of left and right drive mechanisms 7, 7 form a traveling device 19.

On the vehicular chassis 1, a hopper 11 driven by a hydraulic motor, a crusher 8 which is connected to the hopper and driven by a hydraulic motor, an engine 10 for driving a hydraulic pump 18 which supplies a pressurized fluid to respective hydraulic motors and a valve group 9 for switching supply of the pressurized fluid from the hydraulic pump 18 to respective hydraulic motors are mounted.

A portion projecting sidewardly from one side surface **8*a* of the crusher 8 in the vehicular chassis 1 is provided with a hand rail 12 to serve as an operator's platform 13. A pair of left and right traveling levers 14, 14 are provided in the operator's platform 13. On a cover 40 located on the same side as the operator's platform 13, an operation lever 15 for controlling the hopper 11 and the crusher 8 by operating the valve group 9** is provided.

Between a pair of the driving devices 7, 7, a discharge conveyer 16 is provided for vertical rocking motion. The inlet side **16*a* of the discharge conveyer 16 is located just beneath the discharge outlet of the crusher 8. On the other hand, the outlet side 16*b* of the discharge conveyer projects frontwardly from the driving mechanisms 7, 7 and the vehicular chassis 1**.

Next, the detail at respective parts will be discussed.

Figure 5:
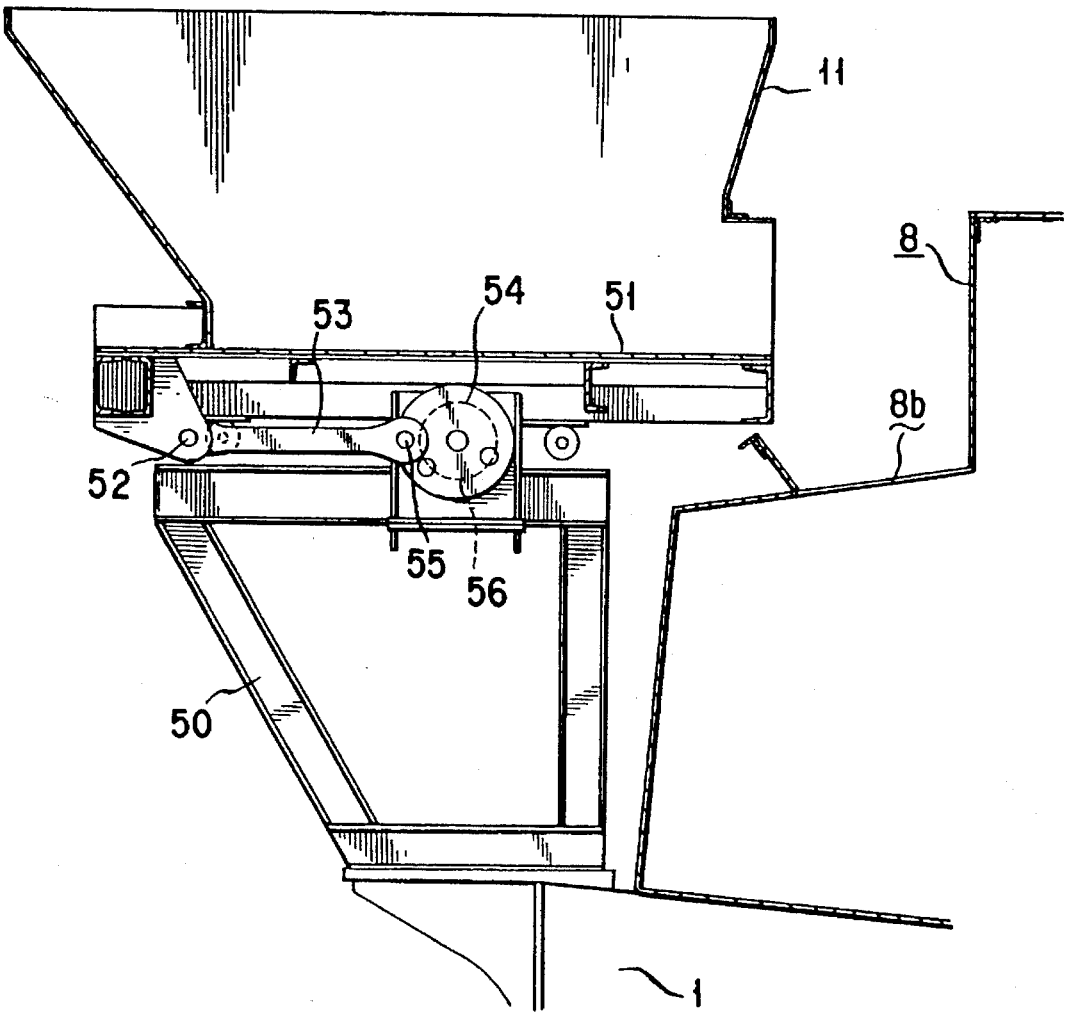
FIG. 5 is a section showing a detail of a hopper portion in the above-mentioned embodiment.

As shown in FIG. 5, the hopper 11 is mounted on a base 50 of the vehicular chassis 1. A bottom plate 51 (buffer member) of the hopper 11 is adapted to horizontally reciprocate toward and away from the charging inlet 8*b* of the crusher 8. One end of a connecting link 53 is connected to the bottom plate 51 via a pin 52. The other end of the connecting link 53 is connected to a circular plate 54 via a pin 55. The circular plate 54 is driven to rotate by means of a hydraulic motor 56.

When the circular plate 54 is driven to rotate, the bottom plate 51 is driven to reciprocate to feed the object of crush charged into the hopper 11 into the charging inlet 8*b* of the crusher 8.

Figure 3:
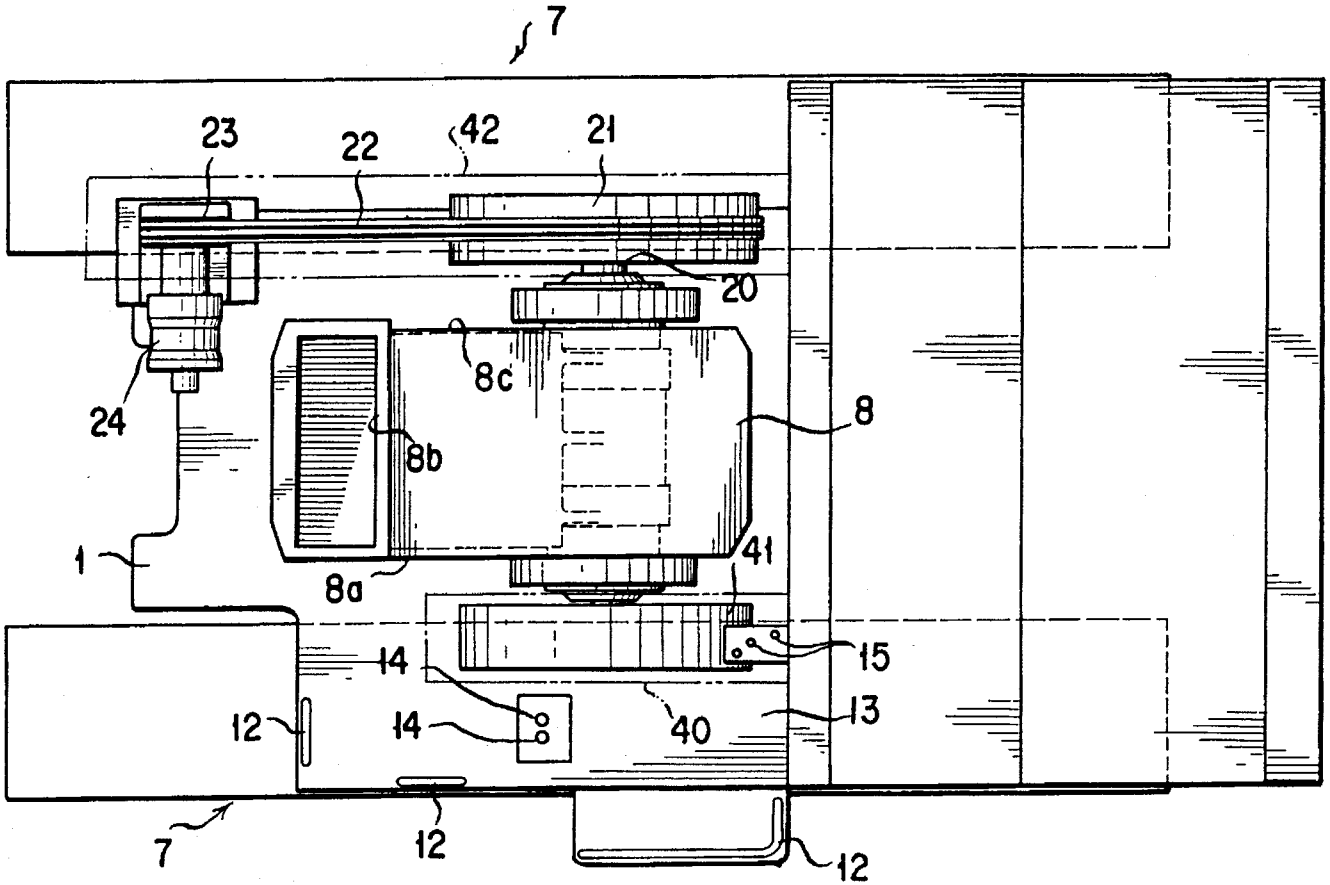
FIG. 3 is a plan view of the above-mentioned embodiment.

As shown in FIG. 3, the rotary shaft 20 of the crusher 8 is provided with a flywheel 41 at one end extending from one side 8*a*. The other end of the rotary shaft is adapted to be driven by a hydraulic motor 24 via a pulley 21, a belt 22 and a pulley 23. The hydraulic motor 24 is positioned at the side or obliquely sideward position of the crusher 8 and at the side 8*c* opposite to the operator's platform 13. The flywheel 41 is surrounded by the cover 40 at the one side 8*a* and the pulley 21, the belt 22 and the pulley 23 are covered by a cover 42 at the other side 8*c*.

Figure 4:
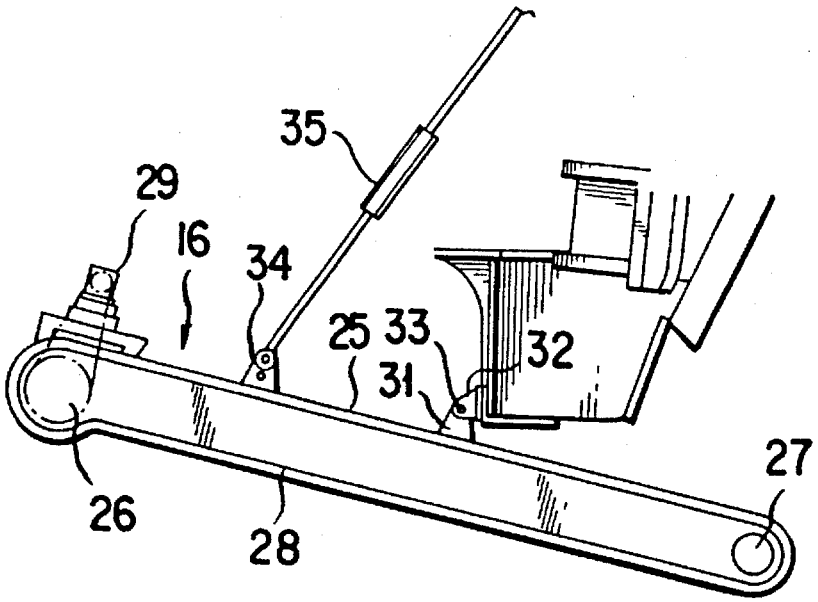
FIG. 4 is a side elevation showing a detail of a discharge conveyer portion in the above-mentioned embodiment.

As shown in FIGS. 2 and 4, the discharge conveyer 16 is provided with a drive pulley 26 and a driven pulley 27 on a frame 25 thereof. A belt 28 is wound around the drive pulley 26 and the driven pulley 27. The drive pulley 26 is adapted to be driven by a hydraulic motor 29. On the frame 25, a V-shaped belt guide 30 is provided so that the belt 28 may run through a V-shaped path. A supporting strip 31 fixed to the frame 25 is pivoted on a bracket 32 which is mounted on the vehicular chassis 1 for vertical pivotal movement about a pin 33. A receptacle piece 34 attached to the frame 25 is connected to the vehicular chassis 1 via a connecting member 35, such as a turn buckle, a rod, a wire or so forth. By adjusting the length of the adjusting member 35, the discharge conveyer 16 may rise and fall between an upwardly tilted position and a horizontal position.

Since the shown embodiment is constructed as set forth above, when the object of crush is charged into the hopper 11, the bottom plate 51 receives the charged object of crush, and subsequently, feeds the received object of crush to the charging inlet 8*b* of the crusher 8 by reciprocal motion thereof. As a result, even when the weight of the object of crush or the charge amount of the object of crush into the hopper fluctuates, a substantially constant amount of object of crush can be fed into the crusher 8. Accordingly, stable crushing operation can be performed by the crusher 8. Also, the hopper 11 may not be blocked by the object of crush.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

The self-propelled crushing machine according to the present invention can be appropriately transported to respective construction sites and can efficiently crush large masses of construction debris, such as concrete block which can be recycled.

We claim:

1. A self-propelled crushing machine comprising:

a vehicular chassis having a self-propelling traveling device and having first and second ends in a longitudinal direction;

a crusher provided at a longitudinally intermediate position of said vehicular chassis;

an operator's platform located at a first lateral side of said crusher;

a hopper located at a position longitudinally shifted from said crusher toward said first end of said vehicular chassis, said hopper cooperating with said crusher for feeding objects to be crushed;

a driving power source located at a position longitudinally shifted from said crusher toward said second end of said vehicular chassis;

a motor powered by said driving power source for driving said crusher, said motor being located at a second lateral side of said crusher opposite to the first lateral side at which said operator's platform is located; and bottom plate means incorporated in said hopper and located between said hopper and said crusher, said bottom plate means being reciprocally movable in horizontal direction relative to a charge inlet of said crusher for feeding a substantially constant amount of the objects to be crushed.

2. A self-propelled crushing machine comprising:

a vehicular chassis having a self-propelling traveling device including a pair of left and right driving mechanisms and having first and second ends in a longitudinal direction;

a crusher provided at a longitudinally intermediate position of said vehicular chassis;

an operator's platform located at a first lateral side of said crusher;

a hopper located at a position longitudinally shifted from said crusher toward said first end of said vehicular chassis, said hopper cooperating with said crusher for feeding objects to be crushed;

a driving power source located at a position longitudinally shifted from said crusher toward said second end of said vehicular chassis;

a motor powered by said driving power source for driving said crusher, said motor being located at a second lateral side of said crusher opposite to the first lateral side at which said operator's platform is located;

a discharge conveyer arranged between said pair of left and right driving mechanisms, a part of said discharge conveyer being extended outward of said vehicular chassis and said traveling device at said first end of said vehicular chassis; and bottom plate means incorporated in said hopper and located between said hopper and said crusher, said bottom plate means being reciprocally movable in horizontal direction relative to a charge inlet of said crusher for feeding a substantially constant amount of the objects to be crushed.

3. A self-propelled crushing machine comprising:

a mobile chassis suspended on a traveling device for self-propelled traveling;

an operator's platform defined on said mobile chassis for enabling an operator to operate said self-propelled crushing machine;

a motor powered crusher mounted on said mobile chassis and operable by an operator on said operator's platform for crushing objects charged thereto;

a hopper mounted on said mobile chassis and coupled with said crusher for charging the objects to be crushed to said motor powered crusher;

a driving power unit mounted on said mobile chassis and coupled with said hopper and said crusher for providing driving power thereto;

said hopper, said crusher and said driving power unit being mutually offset with respect to each other in a longitudinal direction and arranged in alignment in order substantially along a longitudinal axis of said mobile chassis;

said operator's platform being arranged at a position laterally shifted from said longitudinal axis of said mobile chassis along which said hopper, said crusher and said driving power unit are aligned; and bottom plate means incorporated in said hopper and located between said hopper and said crusher, said bottom plate means being reciprocally movable in horizontal direction relative to a charge inlet of said crusher for feeding a substantially constant amount of the objects to be crushed.

4. A self-propelled crushing machine comprising:

a mobile chassis suspended on a traveling device for self-propelled traveling, said traveling device comprising a pair of driving mechanisms provided substantially along left and right side ends of said mobile chassis in mutually spaced apart relationship with a clearance therebetween;

an operator's platform defined on said mobile chassis for enabling an operator to operate said self-propelled crushing machine;

a motor powered crusher mounted on said mobile chassis and operable by an operator on said operator's platform for crushing objects charged thereto;

a hopper mounted on said mobile chassis and coupled with said crusher for charging the objects to be crushed to said motor powered crusher;

a driving power unit mounted on said mobile chassis and coupled with said hopper and said crusher for providing driving power thereto;

a discharge conveyer arranged below said mobile chassis within said clearance between said pair of driving mechanisms, said discharge conveyor being movable between an active position for discharging the objects crushed by said crusher and a resting position;

said hopper, said crusher and said driving power unit being mutually offset with respect to each other in a longitudinal direction and arranged in alignment in order substantially along a longitudinal axis of said mobile chassis;

said operator's platform being arranged at a position laterally shifted from said longitudinal axis of said mobile chassis along which said hopper, said crusher and said driving power unit are aligned; and bottom plate means incorporated in said hopper and located between said hopper and said crusher, said bottom plate means being reciprocally movable in horizontal direction relative to a charge inlet of said crusher for feeding a substantially constant amount of the objects to be crushed.

5. A self-propelled crushing machine comprising:

a mobile chassis suspended on a traveling device for self-propelled traveling, said traveling device comprising a pair of driving mechanisms provided substantially along left and right side ends of said mobile chassis in mutually spaced apart relationship with a clearance therebetween;

an operator's platform defined on said mobile chassis for enabling an operator to operate said self-propelled crushing machine;

a motor powered crusher mounted on said mobile chassis and operable by an operator on said operator's platform for crushing objects charged thereto;

a hopper mounted on said mobile chassis and coupled with said crusher for charging the objects to be crushed to said motor powered crusher;

a driving power unit mounted on said mobile chassis and coupled with said hopper and said crusher for providing driving power thereto;

a motor coupled with said crusher and powered by said driving power unit for driving said crusher;

a discharge conveyer arranged below said mobile chassis within said clearance between said pair of driving mechanisms, said discharge conveyor being movable between an active position for discharging the objects crushed by said crusher and a resting position;

said hopper, said crusher and said driving power unit being mutually offset with respect to each other in a longitudinal direction and arranged in alignment in order substantially along a longitudinal axis of said mobile chassis;

said motor being arranged at a laterally shifted position from said longitudinal axis along which said hopper, said crusher and said driving power unit are aligned on a first lateral side thereof;

said operator's platform being arranged at a position laterally shifted from said longitudinal axis of said mobile chassis along which said hopper, said crusher and said driving power unit are aligned on a second lateral side thereof opposite to the first lateral side on which said motor is arranged; and bottom plate means incorporated in said hopper and located between said hopper and said crusher, said bottom plate means including a rotary actuating member and a linkage mechanism for converting rotation of said rotary actuating member into a reciprocal driving force for reciprocally driving said bottom plate in a horizontal direction relative to a charge inlet of said crusher for feeding a substantially constant amount of the objects to be crushed.

6. A self-propelled crushing machine comprising:

a mobile chassis suspended on a traveling device for self-propelled traveling, said traveling device comprising a pair of driving mechanisms provided substantially along left and right side ends of said mobile chassis in mutually spaced apart relationship with a clearance therebetween;

an operator's platform defined on said mobile chassis for enabling an operator to operate said self-propelled crushing machine;

a motor powered crusher mounted on said mobile chassis and operable by an operator on said operator's platform for crushing objects charged thereto;

a hopper mounted on said mobile chassis and coupled with said crusher for charging the objects to be crushed to said motor powered crusher;

a driving power unit mounted on said mobile chassis and coupled with said hopper and said crusher for providing driving power thereto;

a motor coupled with said crusher and powered by said driving power unit for driving said crusher;

a discharge conveyer arranged below said mobile chassis within said clearance between said pair of driving mechanisms, said discharge conveyor being movable between an active position for discharging the objects crushed by said crusher and a resting position;

said hopper, said crusher and said driving power unit being mutually offset with respect to each other in a longitudinal direction and arranged in alignment in order substantially along a longitudinal axis of said mobile chassis;

said motor being arranged at a laterally shifted position from said longitudinal axis along which said hopper, said crusher and said driving power unit are aligned on a first lateral side thereof;

said operator's platform being arranged at a position laterally shifted from said longitudinal axis of said mobile chassis along which said hopper, said crusher and said driving power unit are aligned on a second lateral side thereof opposite to the first lateral side on which said motor is arranged; and buffering means interposed between said hopper and said crusher for regulating a feeding ratio of the objects to be crushed such that a substantially constant amount of the objects to be crushed are fed from said hopper to said crusher.

* * * * *